US012359854B2

(12) United States Patent
Jarvie

(10) Patent No.: US 12,359,854 B2
(45) Date of Patent: Jul. 15, 2025

(54) GAS COOLER ASSEMBLY FOR TRANSCRITICAL REFRIGERATION SYSTEM

(71) Applicant: Sean Jarvie, Andover, MN (US)

(72) Inventor: Sean Jarvie, Andover, MN (US)

(73) Assignee: Flow Environmental Systems, Inc., Seattle, WA (US)

( * ) Notice: Subject to any disclaimer, the term of this patent is extended or adjusted under 35 U.S.C. 154(b) by 203 days.

(21) Appl. No.: 18/074,979

(22) Filed: Dec. 5, 2022

(65) Prior Publication Data

US 2024/0183587 A1 Jun. 6, 2024

(51) Int. Cl.

| | |
|---|---|
| ***F25B 39/00*** | (2006.01) |
| ***F25B 5/04*** | (2006.01) |
| ***F25B 6/02*** | (2006.01) |
| ***F25B 9/00*** | (2006.01) |
| ***F25B 47/00*** | (2006.01) |
| *F25B 39/04* | (2006.01) |

(52) U.S. Cl.

CPC ..... *F25B 39/00* (2013.01); *F25B 5/04* (2013.01); *F25B 6/02* (2013.01); *F25B 9/008* (2013.01); *F25B 47/006* (2013.01); *F25B 39/04* (2013.01)

(58) Field of Classification Search

CPC .. F25B 39/00; F25B 39/04; F25B 5/04; F25B 6/02; F25B 6/04; F25B 9/008; F25B 47/006; F25B 25/005; F25B 40/02; F25B 2309/061; F25B 2339/00; F25B 2400/0403; F25B 2400/13; F25B 2400/16; F25B 1/10; F24F 3/1405; F28D 1/0426

See application file for complete search history.

(56) References Cited

U.S. PATENT DOCUMENTS

| | | | |
|---|---|---|---|
| 8,356,491 | B2 | 1/2013 | Taras et al. |
| 10,717,338 | B2 | 7/2020 | Duerr et al. |
| 2020/0256602 | A1 | 8/2020 | Zha |
| 2021/0247109 | A1 | 8/2021 | Zhou et al. |
| 2021/0270502 | A1 | 9/2021 | Zha et al. |

FOREIGN PATENT DOCUMENTS

| | | | | |
|---|---|---|---|---|
| CN | 100483041 | C | 4/2009 | |
| CN | 108167954 | A | 6/2018 | |
| CN | 109073283 | A | 12/2018 | |
| EP | 1281545 | A1 * | 2/2003 | ..... B60H 1/00335 |

(Continued)

OTHER PUBLICATIONS

Hussmann; Cop2 Transcritic System Training Manual, (Year: 2018).*

(Continued)

*Primary Examiner* — Emmanuel E Duke

(74) *Attorney, Agent, or Firm* — Kinney & Lange, P.A.

(57) ABSTRACT

A transcritical refrigeration gas cooler assembly comprises at least one gas cooler-condenser having an inlet and an outlet, the inlet configured to receive a carbon dioxide ($CO_2$) refrigerant from a discharge line of a refrigeration system, at least one evaporator having an inlet and an outlet, the inlet fluidly connected to and downstream of the outlet of the at least one gas cooler-condenser, and an expansion valve positioned upstream of the inlet of at least one evaporator.

20 Claims, 4 Drawing Sheets

(56) References Cited

FOREIGN PATENT DOCUMENTS

| | | | | |
|---|---|---|---|---|
| EP | 1281545 B1 * | 11/2004 | ..... | B60H 1/00335 |
| JP | 2005188810 A | 7/2005 | | |

OTHER PUBLICATIONS

Colmac; Fluid Coolers & Condensers Brochure, (Year: 2021).*
Hussmann; CO2 Transcritical systems Training Manual (Year: 2018).*
Colmac; Fluid Cooler & Condensers Brochure (Year: 2021).*
International Search Report and Written Opinion for PCT Application No. PCT/US2023/082263, Dated Mar. 20, 2024, pp. 11.
International Search Report and Written Opinion for PCT Application No. PCT/US2023/082266, Dated Mar. 20, 2024, p. 14.
"Man-Hoe Kim et al: "Fundamental process and system design issues in CO2 vapor compression systems", Progress in Energy and Combustion Science, Elsevier Science Publishers, Amsterdam, NL; Engineering Information, Inc.", New York, NY, US, vol. 30, No. 2, Jan. 1, 2004 (Jan. 1, 2004), pp. 119-174, XP002657414, ISSN: 0360-1285, DOI: 10.1016/J.PECS.2003.09.002, [retrieved on Dec. 18, 2003] pp. 164,165; figure 60.

* cited by examiner

GAS COOLER ASSEMBLY FOR TRANSCRITICAL REFRIGERATION SYSTEM

BACKGROUND

The disclosed subject matter relates to a refrigeration system, and more particularly, to a simultaneous heating and cooling refrigeration system.

Heat pumps are efficient alternatives to furnaces, boilers, chillers, and air conditioners for heating and cooling buildings. In order to heat a primary environment, a heat pump must absorb heat from a secondary environment. To accomplish this, a refrigeration system must create a temperature differential with the ambient temperature of the secondary environment. Heat pump heating systems designed for elevated discharge temperatures typically cannot utilize all of their waste heat and have to reject some to of the waste heat to the secondary environment or another environment external to the system. This rejected energy is wasted energy, especially if the system is actively trying to extract heat from the secondary environment. Thus, a need for a more efficient system is desirable.

SUMMARY

A transcritical refrigeration gas cooler assembly comprises at least one gas cooler-condenser having an inlet and an outlet, the inlet configured to receive a carbon dioxide ($CO_2$) refrigerant from a discharge line of a refrigeration system, at least one evaporator having an inlet and an outlet, the inlet fluidly connected to and downstream of the outlet of the at least one gas cooler-condenser, and an expansion valve positioned upstream of the inlet of at least one evaporator.

A method of operating a transcritical refrigeration gas cooler assembly to recover energy from excess heat comprises receiving a carbon dioxide ($CO_2$) refrigerant at a first refrigerant temperature at an inlet of at least one gas cooler-condenser of the gas cooler assembly, flowing an external airflow through the gas cooler assembly, rejecting heat from the $CO_2$ refrigerant within the at least one gas cooler-condenser to the external airflow to increase an air temperature of the external airflow, and rejecting heat from the external airflow to the $CO_2$ refrigerant within at least one evaporator to increase a temperature of the $CO_2$ refrigerant within the evaporator.

Figure 1:
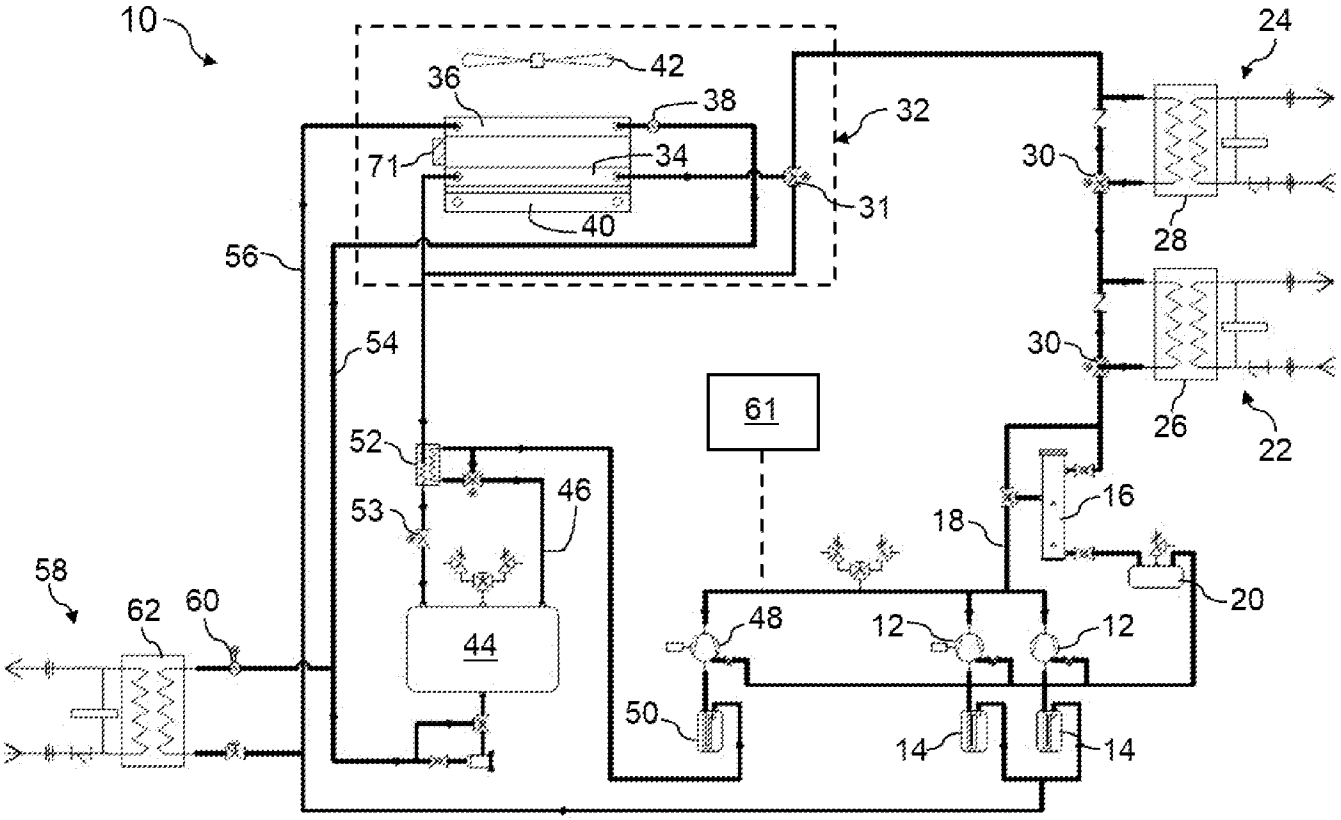
FIG. 1 is a schematic diagram of a transcritical refrigeration system with a gas cooler assembly.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

FIG. 1 is a schematic illustration of refrigeration system 10. Refrigeration system 10 operates in a transcritical state using an R-744 carbon dioxide ($CO_2$) refrigerant as a working fluid. Thus, refrigeration system 10 can be considered a transcritical refrigeration system. R-744 $CO_2$ refrigerant has a critical point at 87.8° F. (31° C.) and 1070 psia ($7.4\times10^3$ kPa). The various components of refrigeration system 10 are discussed herein with reference to the refrigeration cycle.

Refrigeration system 10 includes primary compressors 12, which form a first suction group, for compressing the refrigerant to increase its pressure and temperature. In the embodiment shown, there are two primary compressors 12, but there can be a single primary compressor 12, or more than two (e.g., four) primary compressors 12 in alternative embodiments. In one example the temperature of the compressed refrigerant ranges from about 90° F. to 325° F. (32.2° C. to 162.8° C.) such that the refrigerant is supercritical. Primary compressors 12 can be medium temperature compressors with a lower suction temperature threshold of about 0° F. (−17.8° C.). One liquid accumulator 14 is fluidly connected to each primary compressor 12. Liquid accumulators 14 act as a safety device to prevent any entrained liquid droplets in suction gases from entering primary compressors 12. In an alternative embodiment, a single liquid accumulator 14 can be fluidly connected to multiple primary compressors 12. After compression, refrigerant traverses oil separator 16, positioned downstream of compressors 12 along discharge line 18. Oil separator 16 removes oil and other contaminants from the compressed refrigerant, and these contaminants can be collected in oil receiver 20. Oil separator 16 can be bypassed in certain situations, such as to perform maintenance.

Downstream of oil separator 16 along discharge line 18 are first and second heat reclaim circuits 22 and 24, respectively. First heat reclaim circuit 22 can include heat exchanger 26 through which the refrigerant, at a temperature of around 90° F. to 325° F., can reject heat to a working fluid (e.g., water, a glycol-water mixture, etc.) of an associated system requiring elevated temperatures, such as a boiler (e.g., steam, electric, hot water, etc.), hot water heater, in-floor heating system, district heating system, thermal mass storage system, phase change materials (PCM) storage systems, etc. Accordingly, refrigerant exits first heat reclaim circuit 22 at a reduced temperature ranging from 88° F. to 300° F. (31.1° ° C. to 148.9° C.) depending on the refrigerant temperature entering first heat reclaim circuit 22 and the extent of heat exchange with the circuit's working fluid. Second heat reclaim circuit 24 can be optionally included in refrigeration system 10, and similarly includes heat exchanger 28 through which the refrigerant, at a reduced temperature of 88° F. to 300° F. can reject heat to the working fluid of an associated system, such as any of those listed above with respect to first heat reclaim circuit 22. Second heat reclaim circuit 24 therefore further reduces the temperature of the refrigerant to about 88° F. to 290° F. (31.1° C. to 143.3° C.). Heat exchangers 26 and 28 can be brazed plate, shell-tube, and/or coaxial heat exchangers to name a few non-limiting embodiments. Bypass valves 30 at the inlet to each of heat reclaim circuits 22 and 24 allow for one or both circuits to be bypassed depending on the operation mode of refrigeration system 10.

Downstream of heat reclaim circuits 22 and 24 is gas cooler assembly 32. Gas cooler assembly 32 includes bypass valve 31, gas cooler-condenser 34, evaporator 36, expansion valve 38, adiabatic precooler 40, and fan(s) 42. Bypass valve 31 is positioned upstream of gas cooler assembly 32 and is operable to block refrigerant flow into gas cooler-condenser 34 in a bypass state. In such a state, refrigerant is bypassed to liquid receiver 44. Evaporator 36 is fluidly connected to and downstream of gas cooler-condenser 34, with various intervening components discussed below. Optional damper 71 can be included in gas cooler assembly 32 to allow auxiliary heat into gas cooler assembly, as is discussed in greater detail below with respect to FIGS. 2A and 2B. Refrigerant circulates through gas cooler-condenser 34 and is discharged at a reduced temperature. Accordingly, liquid receiver 44 is positioned downstream of gas cooler-condenser 34 for receiving the refrigerant. After pressure drop from high pressure control valve 53, liquified refrigerant collects at the bottom of liquid receiver 44, and gaseous refrigerant (i.e., "flash gas") rises to the top of liquid receiver 44 where it can be extracted along parallel compressor suction line 46 and provided to parallel compressor 48, a flash gas compressor positioned in parallel with primary compressors 12, and compresses gaseous refrigerant for recirculation through discharge line 18. Parallel compressor 48 can be similarly fluidly connected to liquid accumulator 50 for preventing liquid from entering a respective parallel compressor 48. An alternative embodiment can include more than one parallel compressor 48. Intermediate heat exchanger 52 can optionally be positioned along suction line 46 to superheat suction flash gas and further sub-cool liquid refrigerant.

Line 54 fluidly connects liquid receiver 44 to evaporator 36 of gas cooler assembly 32 via expansion valve 38. Expansion valve 38 reduces the pressure and temperature of the refrigerant upstream of evaporator 36. The refrigerant circulates through and is discharged from evaporator 36 along primary compressor suction line 56 and returns to primary compressors 12. At least a portion of liquified refrigerant from liquid receiver 44 can be provided to optional cooling circuit 58. Expansion valve 60 reduces the temperature and pressure of the liquified refrigerant, and it circulates through heat exchanger 62 of cooling circuit 58 to absorb heat from and cool a working fluid of the associated system, such as a chiller, cooler, freezer, chilled water system, cooling system, etc., used to cool commercial, industrial, or residential spaces, server rooms, data centers, medical facilities, indoor agricultural facilities, thermal mass storage systems, PCM storage systems, or to refrigerate food, medicine, etc. Refrigerant circulated through cooling circuit 58 can be returned to primary compressors 12 along primary suction line 56. System 10 can, therefore, advantageously operate in simultaneous heating and cooling modes such that heat reclaims circuit(s) 22 and/or 24 and cooling circuit 58 are energized and operating to exchange heat without the need for a flow reversing valve to change the direction of flow through system 10.

Figure 2A:
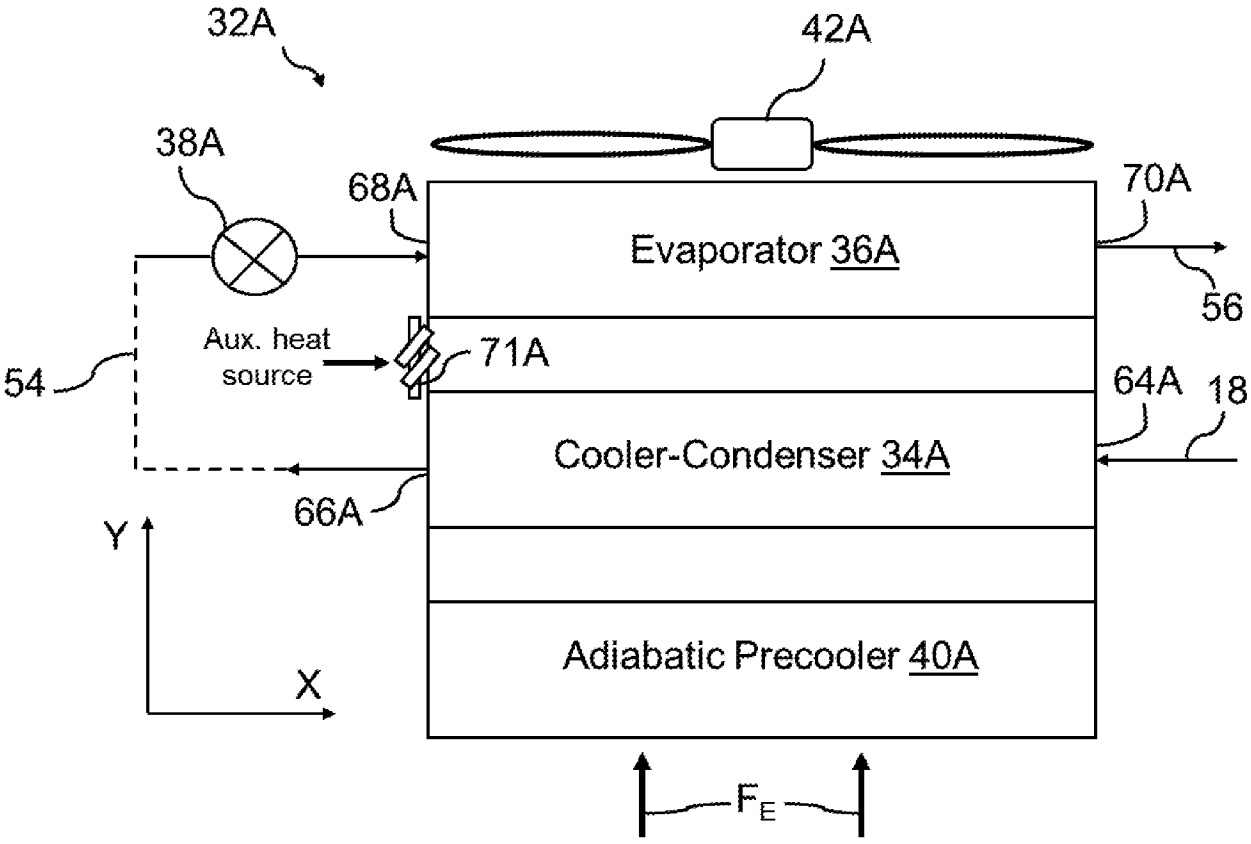
FIG. 2A is a schematic illustration of a first embodiment of the gas cooler assembly.
Figure 2B:
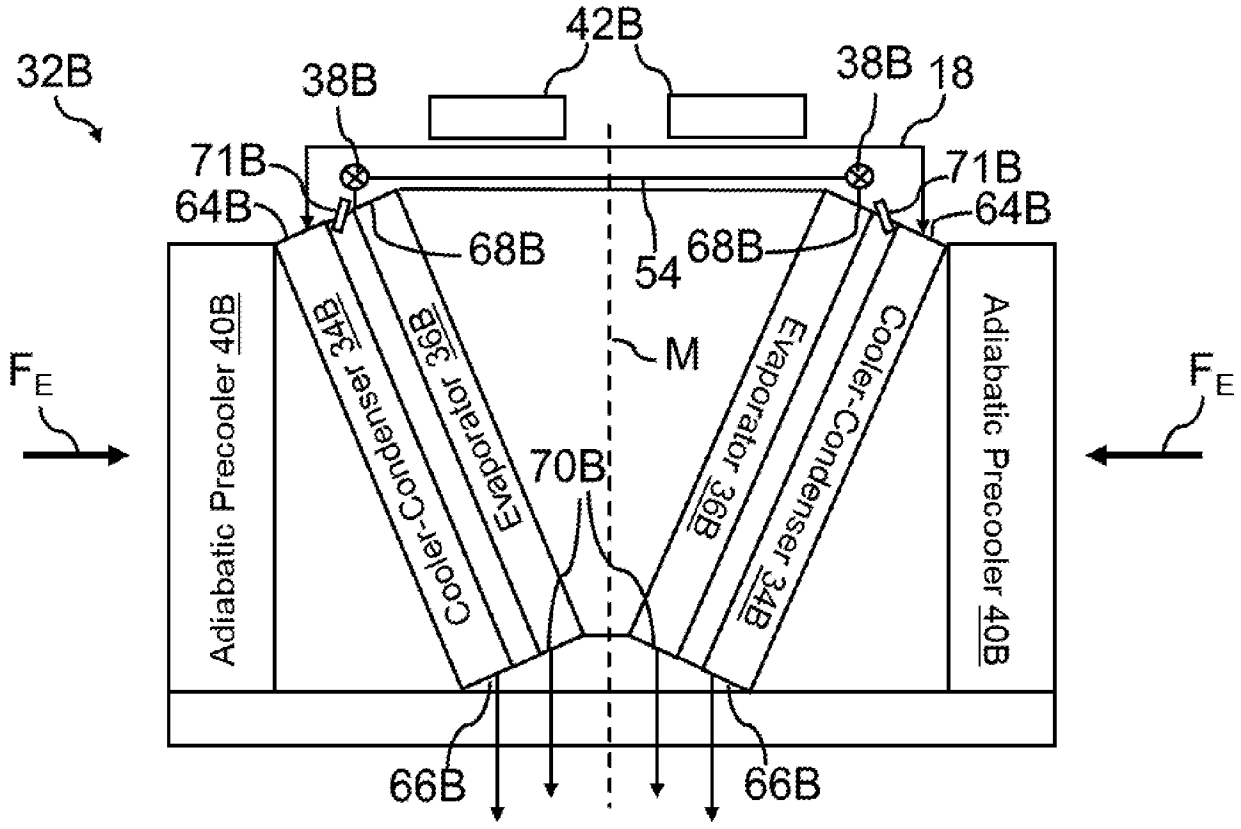
FIG. 2B is a schematic illustration of a second embodiment of the gas cooler assembly.

Gas cooler assembly 32 can be configured as horizontal assembly (as depicted in FIG. 1) or a v-bank assembly. FIG. 2A is a schematic illustration of gas cooler assembly 32A, and FIG. 2B is a schematic illustration of alternative gas cooler assembly 32B, each shown in isolation from the remainder of refrigeration system 10. FIGS. 2A and 2B are discussed below with continued reference to FIG. 1.

Referring first to FIG. 2A, gas cooler assembly 32A, as shown, is a horizontal gas cooler assembly with the various subcomponents stacked along the y-axis to receive fluid along the x-axis. If rotated 90° in either direction such that the various components are instead stacked along the x-axis, gas cooler assembly can alternatively be a vertical gas cooler assembly. Gas cooler-condenser 34A is fluidly connected to discharge line 18 and receives the refrigerant post-circulation through heat reclaims circuits 22, 24 (if included and not bypassed) at inlet 64A and discharges the refrigerant at outlet 66A. In an exemplary operation mode, the refrigerant temperature coming into inlet 64A can range from 88° F. to 300° F. Such inlet temperatures can be achieved, for example, by only circulating the refrigerant through a single heat reclaim circuit (e.g., first heat reclaim circuit 22). While refrigerant is circulating through gas cooler assembly 32A, fan 42A can be operated to draw an external (i.e., outdoor) airflow FE through gas cooler assembly 32A. Adiabatic precooler 40A can cool the incoming airflow FE via evaporative means if the temperature of the incoming airflow is at or above a threshold condition. Accordingly, adiabatic precooler 40A can include adiabatic cooling pads or a nozzle misting system. As airflow FE flows across gas cooler-condenser 34A, it absorbs heat from the refrigerant circulating through gas cooler-condenser 34A if a temperature differential exists between the two fluids. In this way, gas cooler-condenser operates as a heat exchanger, operating in series with upstream heat exchangers 26 and 28. In one example with a relatively cold outdoor temperature between 10° F. and 20° F. (−12.2° ° C. to −6.7° C.) and a refrigerant temperature between 88° F. and 300° F. at gas cooler-condenser 34A, airflow FE can absorb an amount of heat from the refrigerant to generate a relatively warm microclimate downstream of gas cooler-condenser 34A and upstream of evaporator 36A (i.e., in the space between the two), relative to airflow FE. Airflow FE traverses evaporator 36A before being exhausted by fan(s) 42A back to the external environment, often at a higher temperature than that at which it was ingested into gas cooler assembly 32A. Under certain microclimate conditions, bypass valve 31 (FIG. 1) can be operated to bypass refrigerant to liquid receiver 44. Such conditions can include the microclimate capacity (i.e., temperature) exceeding an upper threshold, or when 100% of the usable heat is extracted from the refrigerant, such that no further heat rejection is required.

Evaporator 36A includes inlet 68A and outlet 70A. Expansion valve 38A is positioned upstream of inlet 68A. As discussed above, refrigerant from liquid receiver 44 is cooled and expanded by expansion valve 38A. In one example, the liquid refrigerant can be cooled, by expansion valve 38A from around 90° F.)(32.2° ° C., to less than 32° F. (0° C.). The relatively warmer airflow FE from the microclimate downstream of gas cooler-condenser 34A rejects an amount of heat to the refrigerant circulating through evaporator 36A such that the refrigerant is discharged generally above the lower suction temperature threshold of primary compressors 12 (i.e., 0° F.), and in an exemplary embodiment, above 32° F. (0° C.). In this manner, the microclimate generated by airflow FE first traversing gas cooler-condenser 34A acts to prevent frost formation on downstream evaporator 36A, as the relatively warmer airflow rejects heat to evaporator 36A and maintains the surrounding temperature above the freezing point of water (i.e., 32° F.). Gas cooler assembly 32A can optionally include damper 71A fluidly connected to a source of auxiliary/waste heat from a separate system. Damper 71A is operable to permit the auxiliary heat into the microclimate space between gas cooler-condenser 34A and evaporator 36A.

Referring to FIG. 2B, gas cooler assembly 32B, as shown, is a v-bank gas cooler assembly with two sets of subcomponents generally symmetrically disposed about midline M, and gas cooler-condensers 34B and evaporators 36B angled with respect to midline M to form a "V". Gas cooler assembly 32B can alternatively be an angled gas cooler assembly with only a single set of subcomponents on either side of midline M. Gas cooler assembly 32B is substantially similar to gas cooler assembly 32A, with refrigerant provided to inlet 64B of gas cooler-condensers 34B and being discharge through outlets 66B. Evaporators 36B includes inlets 68B at which cooled refrigerant is provided via expansion valves 38B. Refrigerant is discharged from outlets 70B of evaporators 36B. Fan(s) 42B draw external airflow FE serially across adiabatic precoolers 40B, gas cooler-condensers 34B, and evaporators 36B before exhausting airflow FE back to the external environment. Gas cooler-condensers 34B are similarly configured to generate a microclimate for preventing frost accumulation on evaporators 36B. Gas cooler assembly 32B can also optionally include dampers 71B for permitting auxiliary heat into the microclimate space between each gas cooler-condenser 34B and evaporator 36B.

Referring back to FIG. 1, in some modes of operation, frost can still form and be detected on evaporator 36. In such case, refrigeration system 10 can initiate the first step of a defrost sequence, which operates gas cooler-condenser 34 in a maximum discharge gas temperature state to increase the heat of rejection capacity and elevate the microclimate temperature above 32° F. to defrost evaporator 36. If step 1 alone is not sufficient to defrost evaporator 36, step 2 can be initiated at which system control means throttle the heating output to increase the heating capacity of gas cooler-condenser 34. If defrosting needs are still not met, step 3 can be initiated in which an outdoor cooling coil of gas cooler assembly 32 is turned off and the indoor cooling circuit is engaged while system 10 is still rejecting heat via gas cooler-condenser 34. The defrost sequence can end after a predetermined amount of time or after a "clear" reading from the frost detection system.

Figure 3:
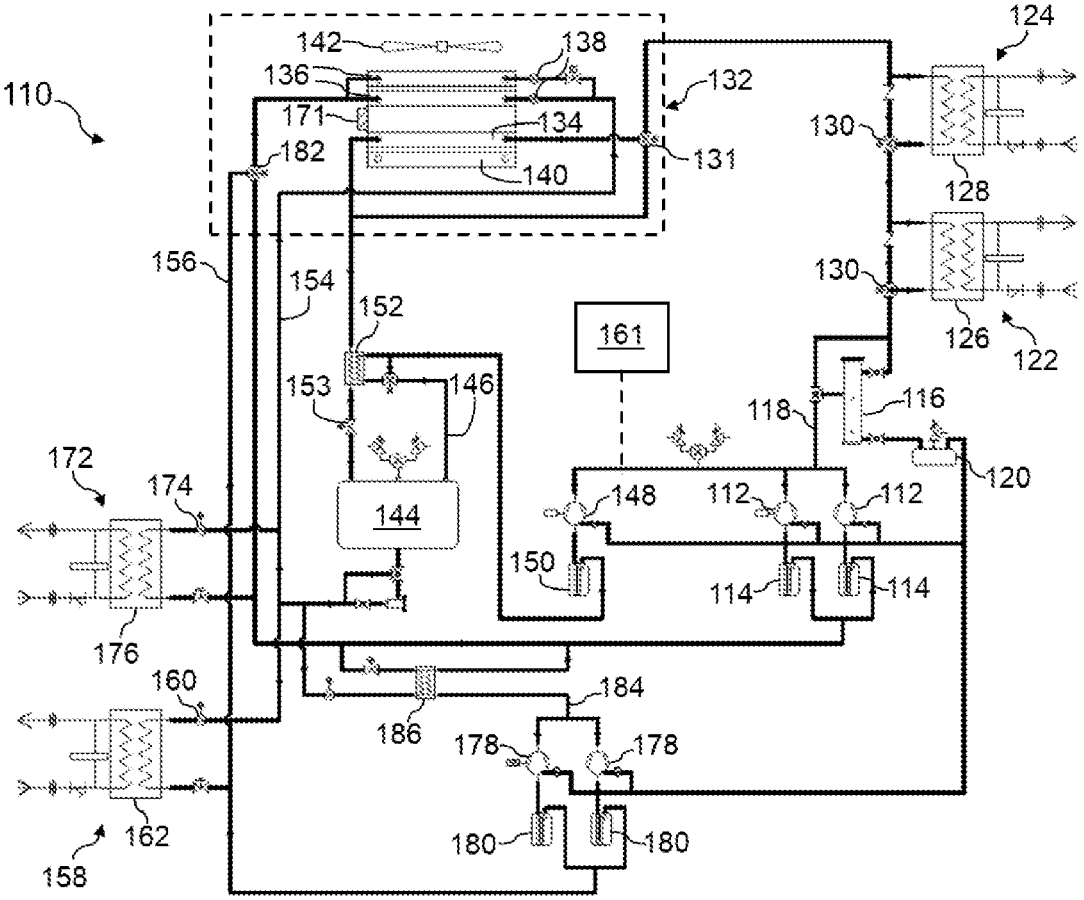
FIG. 3 is a schematic diagram of an alternative embodiment of a transcritical refrigeration system for operating in low ambient conditions.

FIG. 3 is a schematic illustration of alternative refrigeration system 110, configured for operation at low ambient temperatures. Refrigeration system 110 similarly includes medium temperature, primary compressors 112, forming a first suction group, for compressing the refrigerant to a supercritical state. Primary compressors 112 can have a lower suction temperature threshold of about 0° F. One liquid accumulator 114 is fluidly connected to each primary compressor 112, and alternatively, to the entire first suction group. Oil separator 116 removes oil and other contaminants from the compressed refrigerant, and these contaminants can be collected in oil receiver 120.

Refrigeration system 110 further includes first heat reclaim circuit 122 and optional second heat reclaim circuit 124, with heat exchangers 126 and 128, respectively. First and second heat reclaims circuits 122, 124 can be bypassed through operation of bypass valves 130. Gas cooler assembly 132 is downstream of first and second heat reclaims circuits 122, 124 on discharge line 118. Gas cooler assembly 132 can be arranged as a horizontal, vertical, angled, or v-bank gas cooler assembly. Gas cooler assembly 132 includes bypass valve 131, gas cooler-condenser(s) 134 fluidly connected to and upstream of a pair of expansion valves 138, each upstream of a respective associated evaporator 136. Fan(s) 142 operate to draw air across adiabatic precooler(s) 140 and into gas cooler assembly 132. Evaporators 136 can be placed in series and can increase heat absorption of refrigeration system 110. Bypass valve 131 is operable to bypass gas cooler assembly 132 and divert refrigerant to liquid receiver 144. Gas cooler assembly 132 further includes bypass valve 182 downstream of evaporators 136 for bypassing the low temperature suction group, as is discussed in greater detail below. Damper 171 can be positioned within or proximate gas cooler assembly 132 to supply auxiliary heat to the microclimate area. System 110 can further be operable to run a defrost sequence substantially similar to that discussed above with respect to system 10.

Gas cooler-condenser 134 discharges refrigerant to liquid receiver 144. Any gaseous refrigerant can be provided to one or more parallel compressors 148 via parallel compressor suction line 146. Accumulator 150 can be fluidly connected to one or more parallel compressors 148. Intermediate heat exchanger 152 can optionally be positioned upstream of liquid receiver 144 to superheat suction flash gas and further sub-cool liquid refrigerant.

Line 154 fluidly connects liquid receiver 144 to evaporators 136 of gas cooler assembly 132 via expansion valves 138. The refrigerant is discharged from evaporators 136 along primary compressor suction line 156 and returns to primary compressors 112. At least a portion of liquified refrigerant from liquid receiver 144 can be provided to first cooling circuit 158 and second cooling circuit 172. First cooling circuit 158 includes heat exchanger 162 and second cooling circuit 172 includes heat exchangers 176. Expansion valves 160 and 174 reduce the temperature and pressure of the liquified refrigerant, for circulation through heat exchangers 162 and 176, respectively, to absorb heat from and cool a working fluid of the associated cooling systems, such as those listed above with respect to cooling circuit 58 of system 10. Refrigerant circulated through first cooling circuit 158 and/or second cooling circuit 172 can be returned to primary compressors 112 along suction line 156.

Refrigeration system 110 additionally includes low temperature compressors 178 and associated liquid accumulators 180. Low temperature compressors 178 form a second (i.e., low temperature) suction group. Low temperature compressors 178 can operate simultaneously with primary compressors 112 to "boost" refrigerant to a suitable pressure and temperature for primary compressors 112 during low ambient operating conditions with an outside air temperature ranging from −40° F. to −0° F. (−40° C. to −17.8° C.). Low temperature compressors 178 have a low threshold suction temperature as low as −50° F. (−45.5° C.) in an exemplary embodiment, and as low as −69.7° F. (−56.5° C.) in an alternative embodiment. Bypass valve 182 allows for refrigerant to be provided to low temperature compressors 178 during low ambient operating conditions, and for low temperature compressors 178 to be bypassed when not operating in low ambient conditions. Low temperature discharge line 184 provides "boosted" refrigerant to suction line 156 and back to primary compressors 112. Desuperheat exchanger 186 can be positioned in thermal communication with low temperature discharge line 184 and desuperheats the refrigerant to a temperature suitable for primary compressors 112 to recompress the refrigerant.

Refrigeration systems 10, 110 can be in wired or wireless communication with controllers 61, 161 respectively, to control various systems operating modes, microclimate generation, valves, compressors, dampers, fans, etc. Systems 10, 110 can be electrically powered systems, configured to receive electrical power from one or more sources such as fuel, solar, wind, hydro-electric, off grid energy, etc. Controllers 61, 161 can be configured to switch between power sources in some embodiments.

Further alternative embodiments of the disclosed refrigeration systems can include more than two heat reclaim circuits, more than two cooling circuits, more than one gas cooler assembly, and various other associated hardware, to name a few, non-limiting examples.

The disclosed refrigeration systems have many benefits. First, transcritical R-744 $CO_2$ can achieve relatively high temperatures, with the ability to reject heat to various heating systems and having sufficient "waste" heat to generate a microclimate to prevent frost accumulation on the evaporator. The systems can operate simultaneously in heating and cooling modes without the need to reverse refrigerant flow. The gas cooler assemblies operate to recover energy from waste heat in a refrigerant-to-air, then air-to-refrigerant manner by flowing outside air over the gas cooler-condenser to elevate the air temperature to create a microclimate which then elevates the refrigerant temperature in the evaporator. Many existing refrigeration systems recover energy from waste heat in a refrigerant-to-refrigerant manner, which can lead to detrimental superheating of the refrigerant. Finally, the $CO_2$ refrigerant is non-flammable and more environmentally friendly than fluorocarbon-based refrigerants, as it is not an ozone-depleting substance, has a low global warming potential (GWP), and does not degrade into "forever chemicals" like PFAS (per/polyfluoroalkyl substances) refrigerants and other synthetic refrigerants.

Discussion of Possible Embodiments

The following are non-exclusive descriptions of possible embodiments of the present invention.

A gas cooler assembly comprises at least one gas cooler-condenser having an inlet and an outlet, the inlet configured to receive a carbon dioxide ($CO_2$) refrigerant from a discharge line of a refrigeration system, at least one evaporator having an inlet and an outlet, the inlet fluidly connected to and downstream of the outlet of the at least one gas cooler-condenser, and an expansion valve positioned upstream of the inlet of at least one evaporator.

The gas cooler assembly of the preceding paragraph can optionally include, additionally and/or alternatively, any one or more of the following features, configurations and/or additional components:

The above gas cooler assembly can further include at least one adiabatic precooler.

Any of the above gas cooler assemblies can further include at least one fan configured to draw an external airflow into the gas cooler assembly.

Any of the above gas cooler assemblies can further include a bypass valve positioned upstream of the inlet of the at least one gas cooler-condenser.

In any of the above gas cooler assemblies, an external airflow can flow serially across the at least one gas cooler-condenser and the at least one evaporator.

In any of the above gas cooler assemblies, the at least one gas cooler-condenser can receive the $CO_2$ refrigerant at a first refrigerant temperature ranging from 88° F. to 300° F.

In any of the above gas cooler assemblies, the at least one gas cooler assembly can be configured as a horizontal gas cooler assembly.

In any of the above gas cooler assemblies, the at least one gas cooler assembly can be configured as a vertical gas cooler assembly.

In any of the above gas cooler assemblies, the at least one gas cooler assembly can be configured as a v-bank gas cooler assembly.

In any of the above gas cooler assemblies, the at least one gas cooler assembly can be configured as an angled gas cooler assembly.

Any of the above gas cooler assemblies can further include a damper fluidly connected to a source of auxiliary heat, the damper being configured to allow an amount of the auxiliary heat into the gas cooler assembly between the at least one gas cooler-condenser and the at least one evaporator.

Any of the above gas cooler assemblies can further include a bypass valve positioned downstream of the outlet of the at least one evaporator.

In any of the above gas cooler assemblies, the at least one evaporator can include a plurality of evaporators arranged in series.

A method of operating a gas cooler assembly to recover energy from excess heat comprises receiving a carbon dioxide ($CO_2$) refrigerant at a first refrigerant temperature at an inlet of at least one gas cooler-condenser of the gas cooler assembly, flowing an external airflow through the gas cooler assembly, rejecting heat from the $CO_2$ refrigerant within the at least one gas cooler-condenser to the external airflow to increase an air temperature of the external airflow, and rejecting heat from the external airflow to the $CO_2$ refrigerant within at least one evaporator to increase a temperature of the $CO_2$ refrigerant within the evaporator.

The method of the preceding paragraph can optionally include, additionally and/or alternatively, any one or more of the following features, configurations and/or additional components:

In the above method, the first refrigerant temperature can range from 88° F. to 300° F.

In any of the above methods, flowing the external airflow through the gas cooler assembly can include operating at least one fan of the gas cooler assembly to draw the external airflow serially across the at least one gas cooler-condenser and the at least one evaporator.

Any of the above methods can further include drawing the external airflow across at least one adiabatic precooler, and operating the adiabatic precooler above a threshold condition of the external airflow.

In any of the above methods, rejecting heat from the $CO_2$ refrigerant within the at least one gas cooler-condenser to the external airflow can generate a microclimate downstream of the at least one gas cooler-condenser and upstream of the at least one evaporator, relative to a direction of the external airflow.

Any of the above methods can further include preventing frost accumulation on the at least one evaporator using the microclimate when a temperature of the microclimate is at least 32° F.

Any of the above methods can further include bypassing the at least one cooler condenser when a temperature of the microclimate exceeds an upper threshold.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A transcritical refrigeration gas cooler assembly comprising:

at least one gas cooler-condenser comprising an inlet and an outlet, the inlet configured to receive a carbon dioxide ($CO_2$) refrigerant from a discharge line of a refrigeration system;

at least one evaporator stacked with the at least one gas cooler-condenser, wherein at least one evaporator comprises an inlet and an outlet, the inlet fluidly connected to and downstream of the outlet of the at least one gas cooler-condenser;

at least one fan configured to draw an external airflow across the at least one gas-cooler condenser and the at least one evaporator;

a microclimate space between the at least one gas cooler-condenser and the at least one evaporator; and an expansion valve positioned upstream of the inlet of at least one evaporator.

2. The gas cooler assembly of claim 1 and further comprising: at least one adiabatic precooler.

3. The gas cooler assembly of claim 1 and further comprising: at least one fan configured to draw an external airflow into the gas cooler assembly.

4. The gas cooler assembly of claim 1, and further comprising: a bypass valve positioned upstream of the inlet of the at least one gas cooler-condenser.

5. The gas cooler assembly of claim 1, wherein an external airflow flows serially across the at least one gas cooler-condenser and the at least one evaporator.

6. The gas cooler assembly of claim 1, wherein the at least one gas cooler-condenser receives the $CO_2$ refrigerant at a first refrigerant temperature ranging from 88° F. to 300° F.

7. The gas cooler assembly of claim 1, wherein the at least one gas cooler assembly is configured as a horizontal gas cooler assembly.

8. The gas cooler assembly of claim 1, wherein the at least one gas cooler assembly is configured as a vertical gas cooler assembly.

9. The gas cooler assembly of claim 1, wherein the at least one gas cooler assembly is configured as a v-bank gas cooler assembly.

10. The gas cooler assembly of claim 1, wherein the at least one gas cooler assembly is configured as an angled gas cooler assembly.

11. The gas cooler assembly of claim 1 and further comprising: a damper fluidly connected to a source of auxiliary heat, the damper being configured to allow an amount of the auxiliary heat into the gas cooler assembly between the at least one gas cooler-condenser and the at least one evaporator.

12. The gas cooler assembly of claim 11 and further comprising: a bypass valve positioned downstream of the outlet of the at least one evaporator.

13. The gas cooler assembly of claim 12, wherein the at least one evaporator comprises a plurality of evaporators arranged in series.

14. A method of operating a transcritical refrigeration gas cooler assembly to recover energy from excess heat, the method comprising:

receiving a carbon dioxide ($CO_2$) refrigerant at a first refrigerant temperature at an inlet of at least one gas cooler-condenser of the gas cooler assembly;

flowing an external airflow through the gas cooler assembly;

rejecting heat from the $CO_2$ refrigerant within the at least one gas cooler-condenser to the external airflow to increase an air temperature of the external airflow; and rejecting heat from the external airflow to the $CO_2$ refrigerant within at least one evaporator to increase a temperature of the $CO_2$ refrigerant within the evaporator.

15. The method of claim 14, wherein the first refrigerant temperature ranges from 88° F. to 300° F.

16. The method of claim 14, wherein flowing the external airflow through the gas cooler assembly comprises: operating at least one fan of the gas cooler assembly to draw the external airflow serially across the at least one gas cooler-condenser and the at least one evaporator.

17. The method of claim 16 and further comprising: drawing the external airflow across at least one adiabatic precooler, and operating the adiabatic precooler above a threshold condition of the external airflow.

18. The method of claim 14, wherein rejecting heat from the $CO_2$ refrigerant within the at least one gas cooler-condenser to the external airflow generates a microclimate downstream of the at least one gas cooler-condenser and upstream of the at least one evaporator, relative to a direction of the external airflow.

19. The method of claim 18 and further comprising: preventing frost accumulation on the at least one evaporator using the microclimate when a temperature of the microclimate is at least 32° F.

20. The method of claim 18 and further comprising: bypassing the at least one cooler condenser when a temperature of the microclimate exceeds an upper threshold.

* * * * *